US009498088B2

(12) United States Patent
Hinson

(10) Patent No.: US 9,498,088 B2
(45) Date of Patent: Nov. 22, 2016

(54) SHELF SUPPORT STRUCTURE

(71) Applicant: Donald Neal Hinson, Orangevale, CA (US)

(72) Inventor: Donald Neal Hinson, Orangevale, CA (US)

( * ) Notice: Subject to any disclaimer, the term of this patent is extended or adjusted under 35 U.S.C. 154(b) by 0 days.

(21) Appl. No.: 14/712,899

(22) Filed: May 14, 2015

(65) Prior Publication Data

US 2016/0066751 A1 Mar. 10, 2016

Related U.S. Application Data

(60) Provisional application No. 62/046,858, filed on Sep. 5, 2014, provisional application No. 62/078,328, filed on Nov. 11, 2014.

(51) Int. Cl.
*A47K 3/28* (2006.01)
*A47B 55/02* (2006.01)
*A47B 81/00* (2006.01)

(52) U.S. Cl.
CPC ..... *A47K 3/281* (2013.01); *A47B 55/02* (2013.01)

(58) Field of Classification Search
CPC ..... A47K 3/004; A47K 3/281; A47K 5/02; A47B 55/02
USPC ..... 211/119, 119.009, 119.011, 90.03, 106
See application file for complete search history.

(56) References Cited

U.S. PATENT DOCUMENTS 505,360 A * 9/1893 Hilliard ..... A47K 5/02 211/106
3,203,558 A * 8/1965 Ullman ..... A47B 88/0407 211/119
3,391,891 A * 7/1968 Garden ..... B60N 3/102 108/135
4,094,415 A * 6/1978 Larson ..... A47F 5/0823 211/57.1
4,387,811 A * 6/1983 Ragir ..... A47B 55/02 211/106
5,460,279 A * 10/1995 Emery ..... A47B 55/02 211/106
5,620,105 A * 4/1997 Macek ..... A47K 3/001 211/119
5,788,092 A * 8/1998 Teeney ..... B25H 3/04 211/182
D446,670 S * 8/2001 Emery ..... D6/525
6,520,351 B1 * 2/2003 Zadro ..... A47K 3/281 211/106
D471,045 S * 3/2003 Cheng ..... D6/525
7,225,935 B2 * 6/2007 Breymaier ..... A47B 96/067 211/103
7,770,742 B1 * 8/2010 Wagner ..... A47K 3/281 211/113

(Continued)

FOREIGN PATENT DOCUMENTS

AU 2013205986 A1 5/2014
CA 115505 S 5/2007

(Continued)

*Primary Examiner* — Stanton L Krycinski
(74) *Attorney, Agent, or Firm* — Temmerman Law Office; Mathew J. Temmerman

(57) ABSTRACT

A shelf support structure for holding shower or bath accessories adapted to be suspended from the top edge of a shower or bathroom wall having a frame that comprises a pair of spaced-apart vertical legs which ascends up and hooks over and then back down forming an inverted U-shape. The frame is attached to a mounting bar designed to support the weight of the shelf support structure and contents. The mounting bar comprises a pair of slots on opposite ends designed to slip over and lock onto a plurality of securing means that are fastened to the drywall just above the top of the shower or bath wall, thereby preventing the shelf support structure from slipping off the top edge of the wall.

18 Claims, 4 Drawing Sheets

(56) References Cited

U.S. PATENT DOCUMENTS

| | | | | |
|---|---|---|---|---|
| 7,837,044 | B2 * | 11/2010 | Whitty | A47F 1/082 211/106 |
| 7,959,020 | B2 * | 6/2011 | Rosen | D06F 79/02 211/106 |
| D641,190 | S | 7/2011 | Cittadino | |
| D641,191 | S | 7/2011 | Walker | |
| D641,193 | S | 7/2011 | Vaccaro | |
| D641,194 | S | 7/2011 | Vaccaro | |
| D643,236 | S | 8/2011 | Cittadino | |
| D643,657 | S | 8/2011 | Cittadino | |
| D644,050 | S | 8/2011 | Cittadino | |
| D647,746 | S | 11/2011 | Tawil | |
| D652,237 | S | 1/2012 | Cittadino et al. | |
| D653,067 | S | 1/2012 | Cittadino et al. | |
| D661,927 | S | 6/2012 | Cittadino et al. | |
| D661,928 | S | 6/2012 | Sedwick | |
| D662,739 | S | 7/2012 | Gilbert | |
| D667,246 | S | 9/2012 | Cittadino et al. | |
| D676,696 | S | 2/2013 | Primeau | |
| D677,089 | S | 3/2013 | Tawil | |
| D677,956 | S | 3/2013 | Tawil | |
| D677,957 | S | 3/2013 | Tawil | |
| D679,122 | S | 4/2013 | Rojas | |
| D688,064 | S | 8/2013 | Couture | |
| 8,573,416 | B2 * | 11/2013 | Didehvar | A47B 45/00 211/119.009 |
| D694,548 | S | 12/2013 | Snell | |
| D698,183 | S | 1/2014 | Tawil | |
| D698,184 | S | 1/2014 | Tawil | |
| D698,574 | S | 2/2014 | Tawil | |
| D698,575 | S | 2/2014 | Tawil | |
| D698,576 | S | 2/2014 | Tawil | |
| D698,577 | S | 2/2014 | Tawil | |
| D698,578 | S | 2/2014 | Tawil | |
| D698,579 | S | 2/2014 | Tawil | |
| D698,580 | S | 2/2014 | Tawil | |
| D699,974 | S | 2/2014 | Snider | |
| D699,975 | S | 2/2014 | Snider | |
| 8,769,781 | B2 * | 7/2014 | Carney | A47K 3/281 24/457 |
| 2010/0102014 | A1 * | 4/2010 | Yang | A47K 3/281 211/113 |
| 2011/0025180 | A1 * | 2/2011 | Ilich | A47B 95/008 312/237 |
| 2012/0159748 | A1 | 6/2012 | Carney | |
| 2012/0217215 | A1 | 8/2012 | Emery et al. | |
| 2012/0246821 | A1 | 10/2012 | Trentacosta | |
| 2013/0161329 | A1 | 6/2013 | Baines | |
| 2013/0341216 | A1 | 12/2013 | Panzella | |
| 2014/0124598 | A1 * | 5/2014 | Vaccaro | E03C 1/06 239/289 |

FOREIGN PATENT DOCUMENTS

| | | | |
|---|---|---|---|
| CA | 125044 | S | 10/2008 |
| CA | 125046 | S | 10/2008 |
| CA | 125047 | S | 10/2008 |
| CA | 146796 | S | 5/2013 |
| CA | 146639 | S | 10/2013 |
| CN | 202270595 | U | 6/2012 |
| CN | 202410899 | U | 9/2012 |
| CN | 202527296 | U | 11/2012 |
| CN | 202803447 | U | 3/2013 |
| CN | 202823677 | U | 3/2013 |

* cited by examiner

SHELF SUPPORT STRUCTURE

RELATED APPLICATIONS

The application claims priority from the United States provisional application with Ser. No. 62/078,328 filed on Nov. 11, 2014 and from United States provisional application with Ser. No. 62/046,858 filed on Sep. 5, 2014. The disclosures of these provisional applications are incorporated herein as if set out in full.

BACKGROUND OF THE DISCLOSURE

Technical Field of the Disclosure

The present invention relates in general to bathroom accessories commonly known as shelf support structures. More specifically, the present disclosure relates to a shelf support structure with a revolutionary new mounting system.

Description of the Related Art

There are a wide variety of devices for storing personal care products, such as soap, shampoo, conditioner, toothpaste, toothbrushes, razors, washcloths, etc., particularly in showers and baths. These devices are most commonly referred to as shower caddies. Some are configured to fasten directly to the walls of bathtubs and shower stalls, while others are configured to hang from the neck/pipe of a showerhead.

While each of these caddies is functional, they each have major drawbacks. Fastening a shelf to a shower wall requires either the drilling of the walls or the use of some sort of adhesive tape or suction cups. Most homeowners and renters are reluctant to or forbidden to drill holes into the walls of the bath or shower, and adhesive tape and suction cups do not support much weight before losing their grip. As most home owners can attest to, liquid and moisture seeping behind a shower can cause extensive damage, and drilling holes in the otherwise generally impermeable shower wall can be a cause of this.

Existing prior art discloses a shelf support structure that hangs from the neck of the showerhead and hence does not require the destructive drilling of the wall. This form of prior art has an even bigger problem; it is limited in size and capacity due to tilting. The drawback of the neck supported caddy is that it has only a single mounting point, which results in the weight on one side often exceeding the weight on the other side such that the caddy rotates about the neck pipe causing the caddy to tilt, regardless of the griping power around the neck. Even with the use of suction cups, there is still a limit to how much a "single-point-supported" caddy can hold before the suction cups slip, causing the shelf's contents to slide to the lowest side, spill over the edge and fall onto the floor. It is both potentially frustrating and dangerous to the user to have objects falling onto bare feet or on a potentially slippery surface. Because of this single point design, there is a practical limitation to the amount of content the caddies can hold. With the ever-increasing number of personal care products on the market today, the average family is finding the capacity of today's shelf support structure to be significantly insufficient. Furthermore, since there is typically only a single shower neck per shower or bath, any given shower or bath can contain only a single caddy. These and other deficiencies are addressed by the present invention.

Other existing prior art discloses openings in the shelves to allow product dispensers/containers to be stored upside-down to allow draining to the opening side of the dispensers/ containers. In today's market, however, there are a vast variety of dispenser/container designs with a variety of different lids and openings. Further, an increasing segment of the market sells dispensers/containers for the personal care products that either do not fit in or slip out of the openings. Moreover, rendering the overall versatility of this design to be very limiting.

Therefore, there is a need for an improved shelf support structure for holding shower or bath products that would provide nearly unlimited weight capacity and greatly improved stability. Such a needed shelf support structure would provide a locking mechanism that prevents it from accidentally slipping off its mounting point. Such a needed shelf support structure would provide a design, which is suitable for facile mounting, and allows for the removal for the purpose of cleaning. The present embodiment accomplishes these objectives.

SUMMARY OF THE DISCLOSURE

The present invention provides a frame that comprises at least one pair of spaced-apart vertical legs. The pair of vertical legs ascends up and hooks over and then back down forming an inverted U-shape. The frame is attached to a mounting bar designed to support the weight of the shelf support structure and contents placed thereon. The mounting bar is a metal bar that attaches to the top of the shelf support structure and suspends the entire weight of the caddy and its contents.

The mounting bar rests upon the topmost ledge of the shower/bath wall. The mounting bar contains a pair of slots that accepts a plurality of securing means that prevent the mounting bar from slipping off the shower/bath wall ledge. The mounting bar also possesses a handle, which is convenient for the ease of placing and removing the caddy from its mounted position.

The present invention also comprises at least one shelf extended between and attached to the pair of vertical legs for supporting articles. The shelf support structure having at least one soap dish, extended between and attached to the pair of vertical legs, with a slight downward tilt to allow bar soap to slide to the front of the dish. Further, the shelf support structure is provided with at least one tray, extended between and attached to the pair of vertical legs, with holes and slots for various shower accessories such as toothbrushes and razor blades. In addition, a pair of hooks at the bottom edge serves as both washcloth holders and feet to stand the shelf support structure on the ground while it is detached from the wall mounts.

The pair of securing means may be screwed into the stud behind the wall or into a molly bolt type fastener. Since the pair of slots is spaced 16" apart, both mounting screws could be screwed directly into the studs behind the wall for maximum security. The pair of securing means has a hexagon head or round head, a narrower shank, a large washer with a neoprene-like backing and a threaded shank, which screws into the drywall and/or stud just above the shower/bath wall. A Philips head slot allows it to be affixed via a screwdriver or nut driver. Behind the head is a shank that is smaller than the head and narrow enough to fit inside the mounting slot, while the head prevents the mounting bar from slipping off the mounting screw. Behind the shank is a large metal washer with a soft neoprene-type material on its backside. The metal side allows the caddy to easily slide on and off, while the soft neoprene type material minimizes scaring of the wall behind it.

It is a primary objective of the present invention to provide a shelf support structure, which is constructed of either a metal or plastic material to take advantage of the advantages derived from either or both constructions.

It is also a primary objective, in accordance with present invention, to address and eliminate a primary flaw in all existing and prior art forms. This present invention addresses the two major defects of the prior art forms: 1) Tilting when objects are removed or replaced and 2) A limited capacity due to the titling issue stated in item #1. Both issues are caused by utilizing the single mounting point of the shower neck. This invention eliminates the problem by moving the mounting system off of the shower neck and onto to the top of the existing shower/bath wall, placing the entire weight of the present invention onto the top edge of the shower wall. The shelf support structure utilizes the pair of mounting slots and the plurality of screw-like devices to prevent the shelf support structure from sliding off the wall and to provide for simple removal and replacement of the shelf support structure. Although it is possible for these mounting devices to support the weight of the shelf support structure, they are not intended to support the weight of the shelf support structure; instead all weight is supported solely by the wall. This feature makes the present invention 100% immune to tilting since the invention is supported across a mounting bar that is approximately equal to the width of the present invention, and hence the invention is far more stable. Since it is more stable, its capacity is greatly increased and is capable of holding a far greater weight capacity of personal care products and various accessories available today. Additionally, since the present invention is not supported by the shower neck, the possibility of the invention interfering with the hot and cold water mixing valve(s) is eliminated, an issue which is common among today's existing art forms.

It is an additional objective of the present invention to provide a shelf support structure, which is easily removed and replaced to facilitate cleaning of the walls behind the caddy as well as the caddy itself. The present invention is configured with a pair of hooks at the bottom edge that serves as both washcloth holders and landing surfaces (or feet) to stand the shelf support structure on the ground while it is detached from the wall mounts. The shelf support structure can be easily placed on the shower or bathtub floor, allowing the participant use of both hands for cleaning the wall. This removal is further facilitated by a wire piece or plastic back running across the back of the caddy shelves. The majority of existing art forms does not have a back, which forces the participant to empty prior art caddies before removing them for cleaning, leading to potentially all of the contents falling out the back of prior art caddies upon removal.

It is yet another object of the present invention to provide a shelf support structure with a means for optionally storing personal care products upside down to facilitate quick and easy removal of liquid contents therein by allowing liquids to flow near the mouth of the bottle by dividing each shelf into individual smaller sections.

It is still a further object of the present invention to provide a shelf support structure in which one or more soap holding area(s) is configured with a downward tilt to cause the bar soap to slide away from the shower wall to prevent soap scum from dripping down the shower wall. In addition to providing a soap scum solution, it also makes bars of soap easier to remove during a shower or bath due to their automatic positioning by the force of gravity at the front side of the soap dish.

It is another object of the present invention to provide a shelf support structure in which one or more razor blades and/or toothbrushes can be easily stored and removed vertically so that excessive space is not used by storing them horizontally on a shelf. At some area of the present invention, preferably between the two soap dishes, resides an area consisting of holes and slots, thus giving the invention great versatility.

It is yet a further object of the present invention to provide a shelf support structure configured with multiple washcloth hooks that also serve the function of feet for which to rest the shelf support structure upon while the shelf support structure is on the ground during the cleaning of aforementioned walls.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may or may not be fully addressed by any of the features described below.

Figure 1:
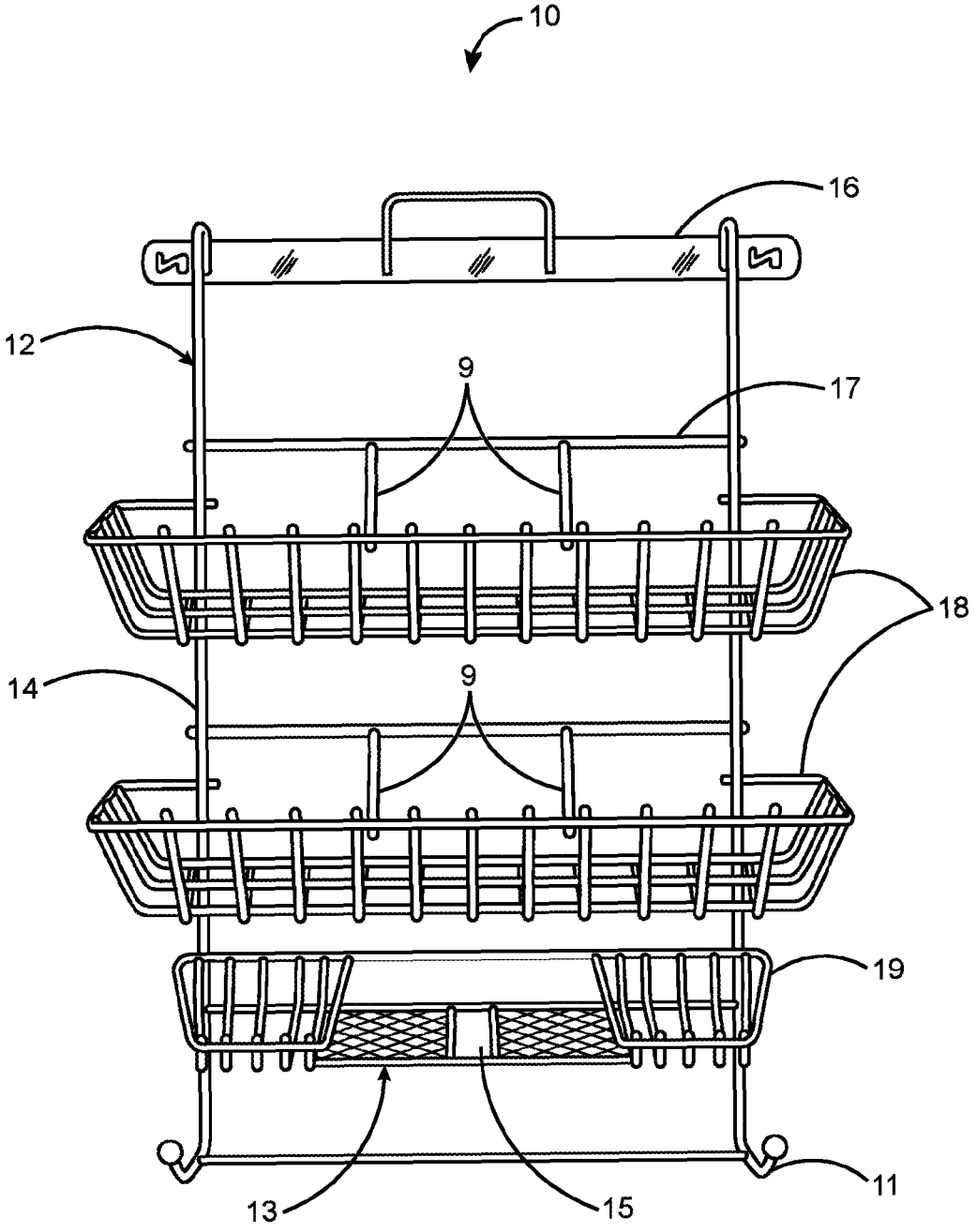
FIG. 1 is a front perspective view of a shelf support structure in accordance with a preferred embodiment of the present invention.

Turning to FIG. 1, a front perspective view of a shelf support structure 10 according to the concepts of the present invention is illustrated. The present invention comprises a frame 12 that comprises a pair of spaced-apart vertical legs 14 which ascend up and hook over and then back down forming an inverted U-shape. The frame 12 is attached thereto a mounting bar 16 designed to support the weight of the shelf support structure 10 and the weight of usual bathroom contents placed thereon. The frame is formed of a material selected from the group consisting of metal such as aluminum, stainless steel and others, plastic, and other suitable materials known in the art.

The mounting bar 16 is a metal or plastic bar that attaches to the top of the shelf support structure 10 and suspends the entire weight of the shelf support structure 10 and its contents. The mounting bar 16 rests upon the topmost ledge of the shower/bath wall. The mounting bar 16 having a pair of slots 22 (see FIG. 2) on opposite ends designed to slip over and lock onto a plurality of securing means 40 (see FIG. 3B), which are fastened to the bare wall or drywall just above the top of the shower or bath wall.

Further, the mounting bar 16 contains a pair of slots 22 (see FIG. 2) that accepts the plurality of securing means 40 (see FIG. 3B), which are specifically designed screws that prevent the mounting bar from slipping off the shower/bath wall ledge. The mounting bar 16 also possesses a handle 24, which is convenient for the ease of placing and removing the shelf support structure 10 from its mounted position. The mounting bar 16 possesses a handle 24 to facilitate placement and removal of the shelf support structure 10 onto the plurality of securing means 40. The mounting bar 16 may comprise a small lip on a bottom edge; the bottom edge width is the same width as the washers on the plurality of securing means 40, which ensures a tight grip on the top edge of shower/bath wall.

The shelf support structure 10 has a unique mechanism for supporting its weight from either the top of the shower wall or even the drywall section above the shower wall with the use the artificial ledge. The construction material preferred is commonly known in the industry as wire rod.

The present invention comprises at least one shelf 18 extended between and attached to the pair of vertical legs 14 for supporting articles. The shelf support structure 10 comprises a backstop 17 that prevents items from falling out of the back of the shelf structure when it is removed from its mounting point. The shelf support structure 10 comprises dividers 9, attached from backstop 17 to front of shelf 18, that prevent items from knocking over adjacent items in a domino effect by dividing up each shelf into multiple compartments, hence solving the problem of storing a plethora of different shaped and sized containers upside down. The shelf support structure 10 comprises at least one soap dish 19, extended between and attached to the pair of vertical legs 14, with a slight downward tilt to allow a bar of soap to slide to the front of the dish. Further, the shelf support structure 10 is provided with at least one tray 13 with holes and slots for various shower accessories such as toothbrushes and a razor blade slot 15 extended between and attached to the pair of vertical legs 14. In addition, a pair of hooks 11 (see FIG. 1) at the bottom edge serves as both washcloth holders and feet to stand the shelf support structure 10 on the ground while it is detached from the wall mounts.

Further, the shelf support structure 10 has a unique feature that is designed for simple removal and replacement of the shelf support structure 10 from its locking mechanism. The locking mechanism does not support the weight of the caddy. The locking mechanism prevents the shelf support structure from slipping off the shower wall. The unique N or L shaped slots 22 in the mounting bar 16 combined with a unique mounting screw 40 (see FIG. 3B) prevent the locking mechanism from coming detached if the caddy is accidentally struck by an elbow or otherwise bumped into by someone in the act of bathing or showering.

Figure 2:
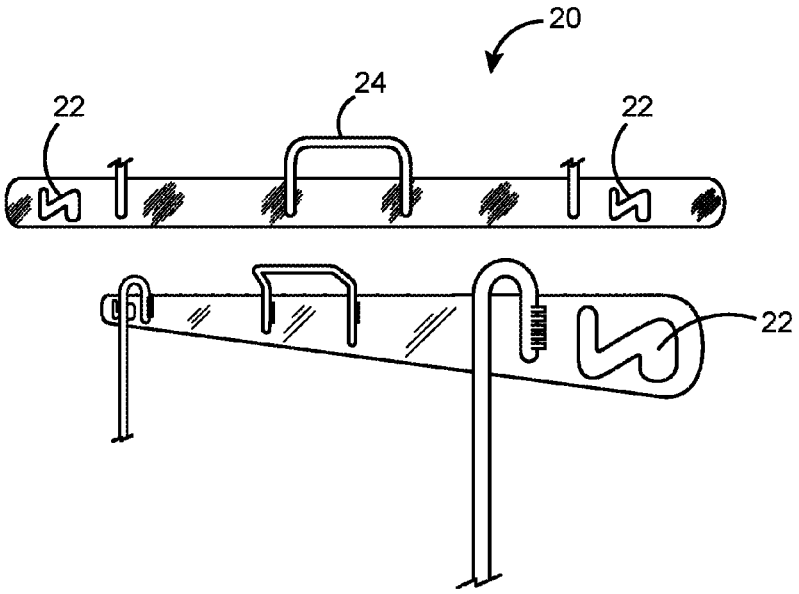
FIG. 2 is a front and angular view of the mounting bar with a pair of slots, a handle and a plurality of mounting points for the caddy.

Referring to FIG. 2, the mounting bar 20 is a metal (or alternatively, plastic) bar that attaches to the top of the shelf support structure 10 (see FIG. 1) and suspends the entire weight of the shelf support structure 10 (see FIG. 1) and its contents. The mounting bar 16 rests upon the topmost ledge of the shower/bath wall or an artificial ledge 50 (see FIG. 4) if desired. The mounting bar 16 contains a pair of slots 22 which is specifically designed N or L shaped slots 22 that accept a pair of securing means 40 (see FIG. 3B) that prevents the mounting bar 16 from slipping off said shower/bath wall ledge. The mounting bar 16 also possesses a convenient handle 24 for the ease of placing and removing the shelf support structure 10 (see FIG. 1) from its mounted position. Additionally, the mounting bar 16 must be wider than the diameter of the washer on the plurality of securing means. The mounting bar 16 also has a lip on its bottom edge to assure the bottom edge presses all the way up against the drywall and makes full contact with the top of the shower wall no matter how thick or thin the wall is, as in the case of a tile shower wall with a rounded top tile.

Figure 3A:
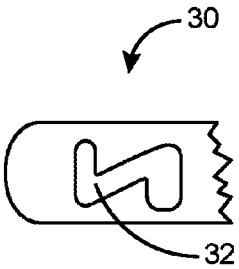
FIGS. 3A and 3B illustrate a pair of mounting slots and a plurality of securing means.

FIG. 3A illustrates a pair of slots 22 cut into the mounting bar (see FIG. 2) 16" apart. Each of the pair of slots 22 consists of an N or L design, with one side of the slot 22 being larger than the opposite side of the slot 22. The wider side allows the head of the plurality of securing means 40 (see FIG. 3B) to easily slip through. Once the head of the plurality of securing means 40 is inserted, the shelf support structure 10 (see FIG. 1) is then slid to the side and then down into its final resting position in the narrower side of the slot. This design makes it nearly impossible to knock the shelf support structure 10 (see FIG. 1) off its mounts when a person is bathing, washing hair or any other activity where a person might accidentally bump into the shelf support structure 10 (see FIG. 1). Even if one side is bumped it cannot slip off the screw head since the slot on the other side of the mounting bar prevents the mounting bar 16 from shifting right or left. If one side is pushed up, it falls directly back down in the correct placement.

Figure 3B:
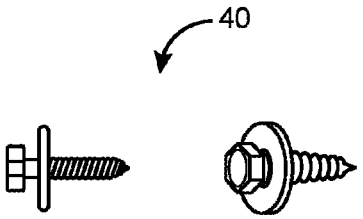

Referring to FIG. 3B, illustrated is the plurality of securing means, which consists of a screw head and a large washer with a small space between the two. The space is slightly larger than the thickness of the mounting bar to allow it to easily slip into place. It can be screwed into the stud behind the wall or into a molly bolt type fastener. Since the pair of slots 22 is spaced 16" apart, both of the plurality of securing means 40 could be screwed directly into the studs behind the wall for maximum security. The plurality of securing means 40 prefer to have a hexagon head and a Philips head slot, allowing it to be affixed via a screwdriver or nut driver. Behind the head is a shank that is smaller than the head and narrow enough to fit inside the mounting slot 22, while the head prevents the mounting bar 16 (see FIG. 2) from slipping off the mounting screw. Behind the shank is a large metal washer with a soft neoprene type material on its backside. The metal side allows the shelf support structure to easily slide on and off while the soft neoprene type material minimizes scaring of the wall behind it.

Figure 4:
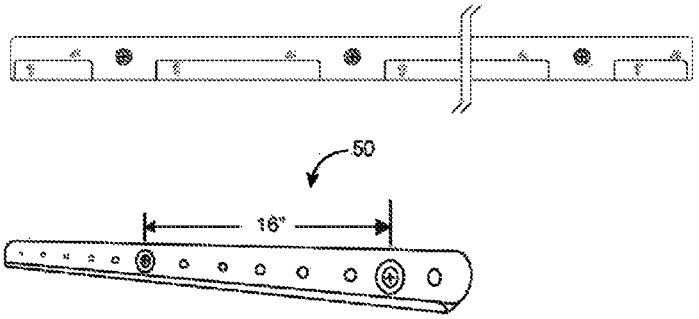
FIG. 4 is a diagram of an artificial shelf component for use in alternative embodiments of the present invention.

Referring to FIG. 4, illustrated is a diagram of multiple artificial shelf components for use in the scenario where the top of a shower wall is rounded, such as in the case of a tile shower where the top row of tiles are set too shallow, in the case where studs are not spaced 16" apart, or in the case where the device is installed in cement or block walls. This is an optional piece, which would seldom be required. It can also be used for offsetting the shelf support structure 10 (see FIG. 1) from wall studs.

Figure 5:
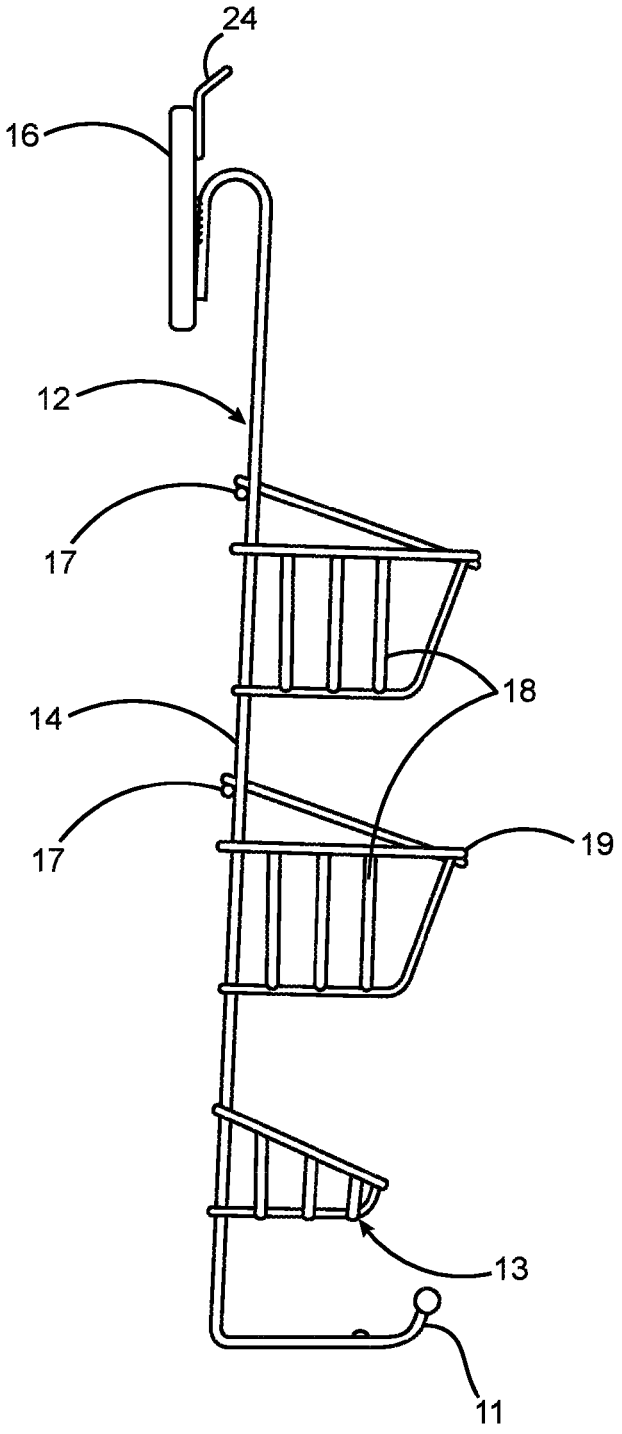
FIG. 5 illustrates a side view of the shelf support structure in accordance with a preferred embodiment of the present invention.

FIG. 5 illustrates a side view of the shelf support structure in accordance with a preferred embodiment of the present invention. The shelf support structure 10 comprises at least one shelf 18 extended between and attached to the pair of vertical legs 14 for supporting articles. The shelf support structure 10 comprises at least one soap dish 19 extended between and attached to the pair of vertical legs 14 with a slight downward tilt to allow a bar of soap to slide to the front of the dish. Further, the shelf support structure 10 is provided with at least one tray 13, with holes and slots (not shown) for various shower accessories such as toothbrushes and razor blades, extended between and attached to the pair of vertical legs 14. In addition, a pair of hooks 11 at the bottom edge serves as both washcloth holders and feet to stand the shelf support structure 10 on the ground while it is detached from the wall mounts. The mounting bar facilitates to ensure a nice tight grip on the top edge of a shower/bath wall.

Figure 6:
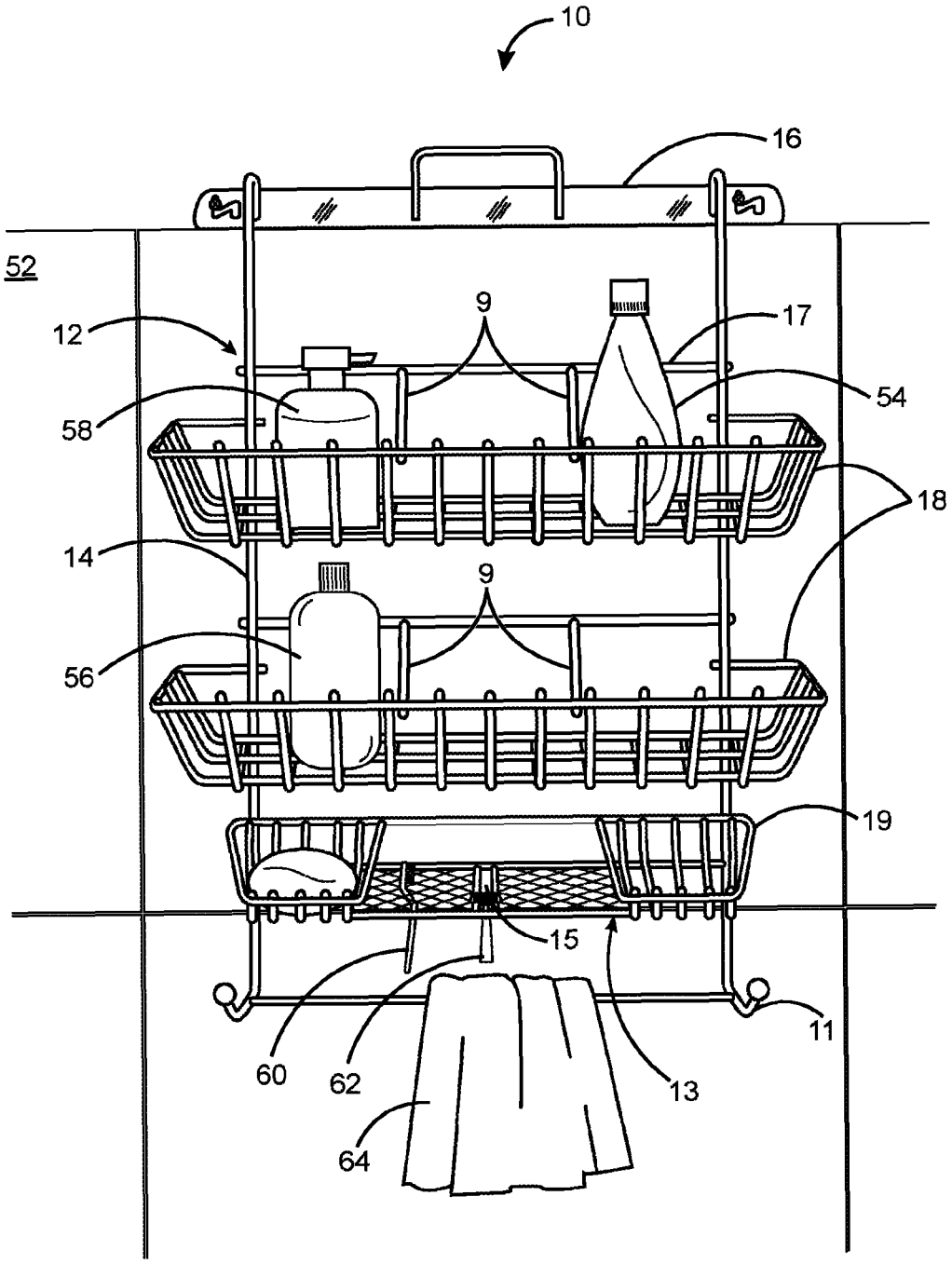
FIG. 6 illustrates a perspective view of the shelf support structure suspended from a bathroom wall when in use.

FIG. 6 illustrates a perspective view of the shelf support structure suspended from a bathroom wall 52 when in use. The shelf support structure 10 comprises at least one shelf 18 extended between and attached to the pair of vertical legs 14 for supporting articles such as a bottle of shampoo 54, hair conditioner 56, cleaning jell 58 and the like. The shelf support structure 10 further comprises a backstop 17 that prevents items from falling out of the back of the shelf structure when it is removed from its mounting point. The shelf support structure 10 comprises at least one pair of dividers 9 that prevent toppling and facilitate storing containers upside down to allow for draining. The shelf support structure 10 comprises at least one soap dish 19 extended between and attached to the pair of vertical legs 14 with a slight downward tilt to allow a bar of soap to slide to the front of the dish. Further, the shelf support structure 10 is provided with at least one tray 13 with holes and slots for receiving the handle of at least one toothbrush 60 and razor blade 62. In addition, a pair of hooks 11 at the bottom edge serves as both washcloth holders for hanging at least one towel 64 or the like and feet to stand the shelf support structure 10 on the ground while it is detached from the wall mounts.

The foregoing description of the preferred embodiment of the present invention has been presented for the purpose of illustration and description. It is not intended to be exhaustive or to limit the invention to the precise form disclosed. Many structural modifications and variations are possible in the shelf support structure 10 of the above teachings. It is intended that the scope of the present invention not be limited by this detailed description but by the claims and the equivalents to the claims appended hereto.

What is claimed is:

1. A shelf support structure for holding bath accessories:

a frame comprised of a at least one pair of spaced-apart vertical legs which ascend up and hook over and then back down forming an inverted U-shape, the frame being attached thereto a mounting bar supporting the weight of the shelf support structure, the mounting bar resting upon a top ledge of a shower or bath wall and having a bottom edge, a pair of slots on opposite ends locked onto a plurality of wall mounts which are fastened to a wall above the top ledge of the shower or bath wall thereby preventing the shelf support structure from slipping off the top ledge of the wall, the wall mounts further comprising a washer;

at least one shelf extended between and attached to the pair of vertical legs for supporting articles thereon;

at least one soap dish extended between and attached to the pair of vertical legs, the soap dish tilted toward a soap dish front side-to allow bar soap to slide to the front of the dish;

at least one tray extended between and attached to the pair of vertical legs, with holes and slots for various shower accessories and a razor blade slot; and a pair of hooks at the bottom edge that serves as both washcloth holders and feet to stand the shelf support structure on the ground while detached from the wall mounts.

2. The shelf support structure of claim 1 wherein the mounting bar possesses a handle for facile placement and removal of the shelf support structure from a mounted position.

3. The shelf support structure of claim 1 wherein the plurality of wall mounts comprises a hexagon or round head, a shank, or a threaded shank or screw.

4. The shelf support structure of claim 3 wherein the wall mounts are screwed directly into drywall and/or a stud behind the wall.

5. The shelf support structure of claim 1 wherein the mounting bar possesses a lip on said bottom edge.

6. The shelf support structure of claim 1 wherein the frame is formed of a material selected from the group consisting of metal and/or plastic.

7. A shelf support structure for holding bath accessories:

a frame comprised of at least one pair of spaced-apart vertical legs which ascend up and hook over and then back down forming an inverted U-shape, the frame being attached thereto a mounting bar supporting the weight of the shelf support structure, the mounting bar resting upon a top ledge of a shower or bath wall and having a bottom edge and a pair of slots on opposite ends locked onto a plurality of wall mounts which are fastened to a wall above the top ledge of the shower or bath wall, thereby preventing the shelf support structure from slipping off the top ledge of the wall, the mounting bar including a handle for facile placement and removal of the shelf support structure from a mounted position;

at least one shelf extending between and attached to the pair of vertical legs for supporting articles thereon;

at least one backstop that prevents the bath accessories from falling out the back of the at least one shelf;

at least one pair of dividers that prevent items from toppling over and facilitates storing containers upside down to allow for draining;

at least one soap dish extended between and attached to the pair of vertical legs, the soap dish tilted toward a soap dish front side-to allow items to slide to the front of the dish;

at least one tray extended between and attached to the pair of vertical legs, with holes and slots for various shower accessories and a razor blade slot; and a pair of hooks at the bottom edge that serves as both washcloth holders and feet to stand the shelf support structure on the ground while detached from the wall mounts.

8. The shelf support structure of claim 7 wherein the plurality of wall mounts comprises a hexagon or round head, a shank, or a threaded shank or screw.

9. The shelf support structure of claim 8 wherein the wall mounts are screwed directly into drywall and/or a stud behind the wall.

10. The shelf support structure of claim 7 wherein the mounting bar possesses a lip on said bottom edge.

11. The shelf support structure of claim 7 wherein the frame is formed of a material selected from the group consisting of metal and plastic.

12. A shelf support structure for holding bath accessories, the shelf supporting structure comprising:

a frame comprised of a pair of spaced-apart vertical legs which ascend up and hook over and then back down forming an inverted U-shape, the frame being attached thereto a mounting bar supporting the weight of the shelf support structure, the mounting bar having a bottom edge and a pair of slots on opposite ends locked onto a plurality of wall mounts which are fastened to a wall just above a top ledge of the shower or bath wall, thereby preventing the shelf support structure from slipping off the top ledge of the wall, the mounting bar possessing a handle for facile placement and removal of the shelf support structure from a mounted position;

at least one shelf extending between and attached to at least one pair of vertical legs for supporting articles thereon;

at least one backstop that prevents the bath accessories from falling out the back of the at least one shelf;

at least one pair of dividers, attached to the backstop, that prevent items from toppling over and facilitates storing containers upside down to allow for draining;

at least one soap dish extended between and attached to the pair of vertical legs, the soap dish tilted toward a soap dish front side to allow bar soap to slide to the front of the dish;

at least one tray extended between and attached to the pair of vertical legs, with holes and slots for various shower accessories and a razor blade slot; and a pair of hooks at the bottom edge that serves as both washcloth holders and feet to stand the shelf support structure on the ground while detached from the wall mounts;

whereby the shelf support structure is designed for removal and replacement of the shelf support structure from said wall mounts.

13. The shelf support structure of claim 12 wherein the wall mounts prevent the shelf support structure from slipping off the shower wall.

14. The shelf support structure of claim 12 wherein the mounting bar includes a handle for facile placement and removal of the shelf support structure from its mounted position.

15. The shelf support structure of claim 12 wherein the plurality of wall mounts comprises a hexagon or round head, shank, or a threaded shank or screw.

16. The shelf support structure of claim 15 wherein the wall mounts are screwed directly into drywall and/or a stud behind the wall.

17. The shelf support structure of claim 12 wherein the mounting bar possesses a lip on said bottom edge.

18. The shelf support structure of claim 12 wherein the frame is formed of a material selected from the group consisting of metal and plastic.

* * * * *